United States Patent [19]

Yamazaki

[11] Patent Number: 4,606,314

[45] Date of Patent: Aug. 19, 1986

[54] IGNITION ANGLE ADVANCER FOR INTERNAL COMBUSTION ENGINE

[75] Inventor: Toshiyuki Yamazaki, Iwata, Japan

[73] Assignee: Sanshin Kogyo Kabushiki Kaisha, Hamamatsu, Japan

[21] Appl. No.: 634,992

[22] Filed: Jul. 27, 1984

[30] Foreign Application Priority Data

Jul. 29, 1983 [JP] Japan ..... 58-137643
Nov. 8, 1983 [JP] Japan ..... 58-208253

[51] Int. Cl.[4] ..... F02P 5/02
[52] U.S. Cl. ..... 123/413
[58] Field of Search ..... 123/413, 395, 400, 403

[56] References Cited

U.S. PATENT DOCUMENTS 1,611,054 12/1926 Mayoral ..... 123/413
2,094,860 10/1937 Timian et al. ..... 123/413
3,807,372 4/1974 Garcea ..... 123/413
4,528,953 7/1985 Flaig et al. ..... 123/413

*Primary Examiner*—Andrew M. Dolinar
*Attorney, Agent, or Firm*—Ernest A. Beutler

[57] ABSTRACT

A spark and throttle control arrangement for an internal combustion engine for altering the spark advance angle in response to the position of the throttle valve. The mechanism includes a throttle control lever and a spark control lever that are pivotally supported about independent pivot axes and a cam and follower arrangement operative between them so as to effect more rapid pivotal movement of the spark control lever than that of the throttle control lever during a phase of the initial rotation of the throttle control lever. Embodiments are disclosed so that the spark advance curve may be tailored to that of the engine by providing different rates of advance during different degrees of throttle opening and/or including a dwell.

4 Claims, 8 Drawing Figures

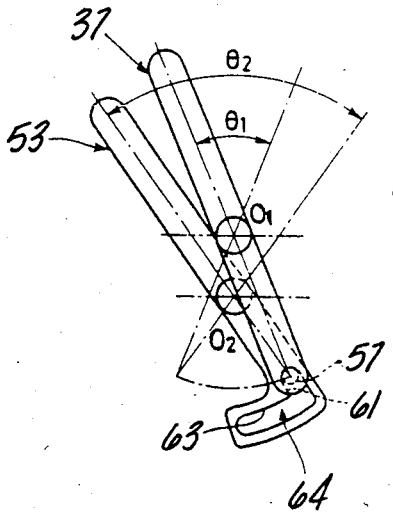
Fig-6
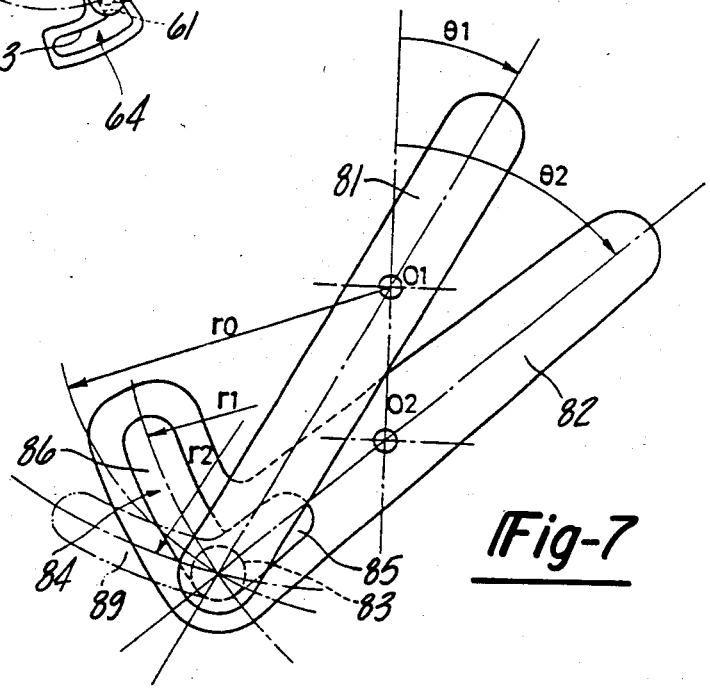
Fig-7
Fig-8
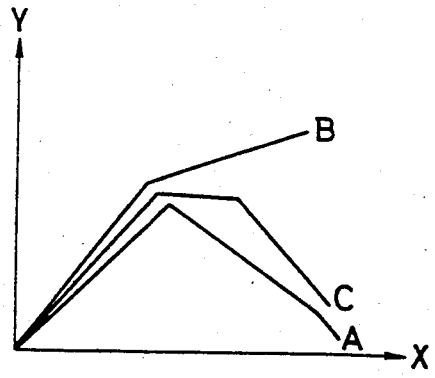

IGNITION ANGLE ADVANCER FOR INTERNAL COMBUSTION ENGINE

BACKGROUND OF THE INVENTION

This invention relates to an ignition angle advancer for an internal combustion engine and more particularly to an improved arrangement for advancing the spark advance angle of an internal combustion engine in response to changes in throttle position.

In many internal combustion engines, there is provided a mechanical interconnection between the throttle control mechanism and the spark control mechanism for advancing the spark angle in response to opening of the throttle. For example, in outboard motors, it is the common practice to mount a throttle control linkage on the side of the engine which is controlled by a remote cable and which positions the throttle valve of the engine. In addition, a spark advance control lever is mounted coaxially with the throttle control lever and is connected to it by means that include a lost motion connection so that the spark advance will be controlled in response to throttle position. Although such arrangements offer certain advantages, such as compactness, they have a number of disadvantages. For example, the actual magnitude of movement of the spark advance mechanism required to provide the necessary degree of advance is often substantially greater than the relates corresponding angular movement of the throttle valve. In order to achieve such magnified movements, it has been necessary to provide a substantially longer lever arm for the spark advance mechanism than for the throttle mechanism. Due to the placement of the other components of the engine, such long levers are not always possible.

It is, therefore, a principal object of this invention to provide an improved throttle and spark advance mechanism for an internal combustion engine.

It is another object of the invention to provide an improved spark advance mechanism that is controlled by a throttle valve lever and which has an amplified range of movement.

In addition to the aforenoted defect, the prior art constructions have resulted in an arrangement wherein the movement of the spark advance mechanism is directly related to the movement of the throttle valve. However, the actual spark advance desired characteristics of the engine may not have such a linear relationship.

It is, therefore, a further object of this invention to provide an improved actuating arrangement for the spark advance mechanism of an internal combustion engine.

It is a further object of the invention to provide a spark advance mechanism for an internal combustion engine wherein the spark may be advanced in a non-linear relationship relative to the throttle valve movement.

SUMMARY OF THE INVENTION

The invention is adapted to be embodied in a throttle and spark advance control system for an internal combustion engine having a spark advance machanism and a throttle valve. A control lever is supported for pivotal movement about an axis and is adapted to be rotated under operator control. Means operatively connect the throttle control lever to the throttle valve for positioning the throttle valve in response to movement of the throttle lever. A spark advance control lever is supported for pivotal movement about an axis and is operatively connected to the spark advance mechanism for controlling the degree of spark advance. In accordance with the invention, means are provided for effecting pivotal movement of the spark advance control lever at a different angular velocity than that of the throttle valve control lever during at least a portion of the range of movement of the throttle control lever.

BRIEF DESCRIPTION OF THE DRAWINGS

FIG. 6 is a reduced scale, partially schematic view, showing the interrelationship between the throttle and spark control levers of this embodiment.

FIG. 7 is a schematic view, in part similar to FIG. 6 but on a larger scale, and shows the construction in accordance with another embodiment of the invention.

FIG. 8 is a diagrammatic view showing how the relationship between the movements of the spark and throttle control levers may be varied in accordance with the invention.

DETAILED DESCRIPTION OF THE PREFERRED EMBODIMENTS

Figure 1:
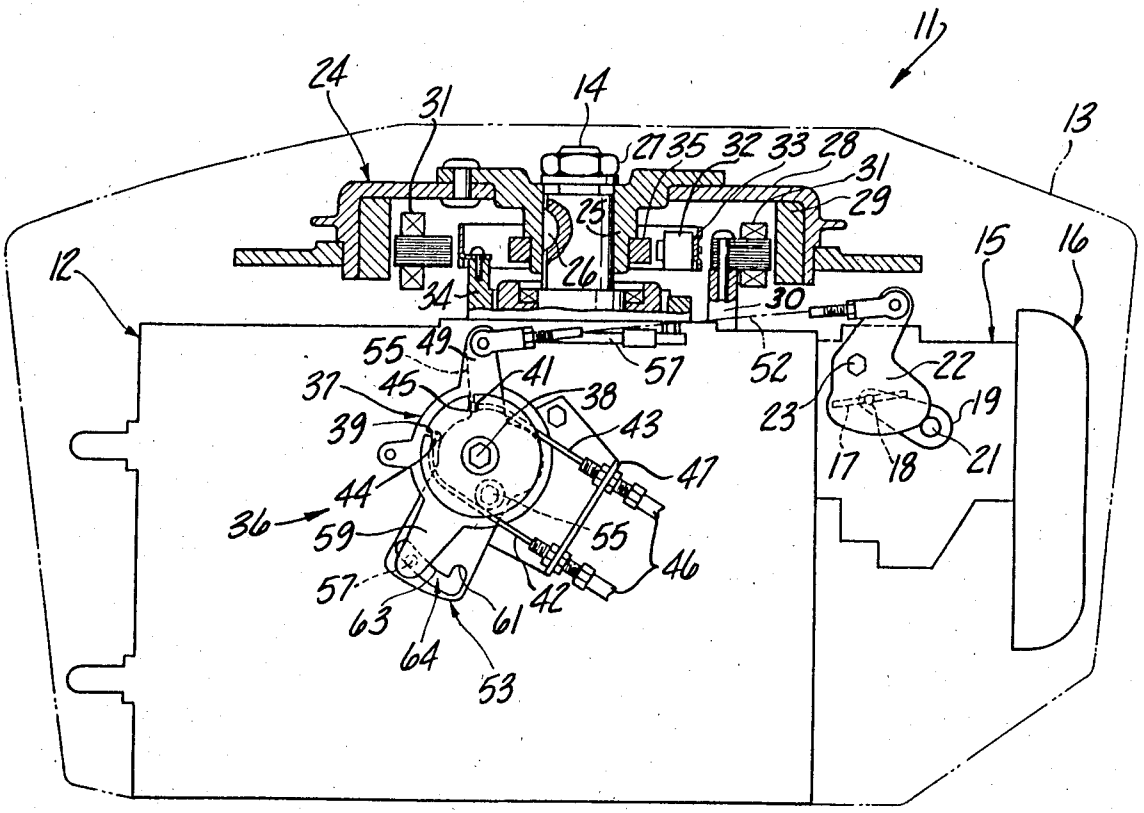
FIG. 1 is a partial side elevational view of the power head of an outboard motor construction in accordance with an embodiment of the invention, with portions broken away and other portions shown in phantom.

Referring first to FIG. 1, the power head of an outboard motor constructed in accordance with an embodiment of the invention is identified generally by the reference numeral 11. The power head 11 includes an internal combustion engine, indicated generally by the reference numeral 12, which is enclosed within a protective cowling, shown in phantom and identified by the reference numeral 13. The engine 12 may be of any known type but, as is typical with outboard motor practice, it is disposed with its output shaft 14 supported for rotation about a generally vertically extending axis. The output shaft 14 is coupled to a drive shaft (not shown) that extends through a drive shaft housing which is positioned below the power head 11 and which drives a propeller in an associated lower unit in a known manner. Since the drive shaft and final drive arrangement of the outboard motor forms no part of this invention, it has not been illustrated nor will it be described in any more detail.

The engine 12 is provided with one or more charge formers, which may consist of carburetors, indicated generally by the reference numeral 15. The carburetors 15 draw induction air from the area within the protective cowling 13 through an air inlet device 16, which may be of any known type. Each carburetor has a respective throttle valve 17 that is affixed to a throttle valve shaft 18. If multiple carburetors are employed, the throttle valve shafts 18 of the various carburetors will be connected together for simultaneous rotation in an appropriate manner. A control lever 19 is affixed to the throttle valve shaft 18 and has a roller follower 21. The roller follower 21 is engaged by a cam surface of a throttle control cam 22 which is journaled on the side of the carburetor 15 by means of a pivot bolt 23. The manner of actuation of the throttle control cam 22 will be described later.

The engine 12 also includes an ignition system that consists of a flywheel magneto assembly, indicated generally by the reference numeral 24. The flywheel magneto assembly 24 includes a hub portion 25 that is non-rotatably connected to the output shaft 14 by means of a key and keyway 26. The flywheel magneto 24 is also axially affixed to the shaft 14 by means of a nut 27.

The flywheel magneto 24 has affixed to its hub portion 25 a generally cup-shaped member 28 which forms the flywheel and which also carries on its inner periphery a plurality of permanent magnets 29. The magnets 29 cooperate with respective charging coils 31 that are fixed on a supporting ring 30 to the upper face of the engine 12. The charging coils 31 provide a source of power for the ignition system and, if desired, can also form a portion of an alternator circuit for generating other electrical power.

The ignition system further includes one or more triggering coils 32 that are supported on a ring 33 which, in turn, is carried by a rotatable base 34 that is supported for rotation relative to the engine 12 in a known manner. The triggering coils 32 cooperate with a magnet assembly 35 that is affixed to the flywheel hub 25 in proximity to the coils 32. The particularly ignition system used forms no part of the invention and, for that reason, has not been described in detail. However, rotation of the base 34 rotates the triggering coils 32 relative to the output shaft 14 and changes the timing of the spark firing. The means for rotating the base 34 and its interconnection with the means for controlling the position of the throttle valve 17 will now be described in detail.

Figure 2:
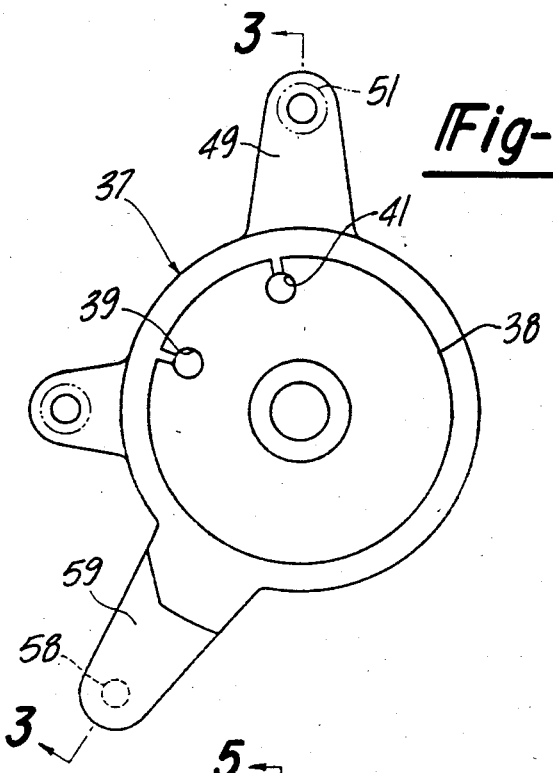
FIG. 2 is an enlarged side elevational view of the throttle control lever.
Figure 3:
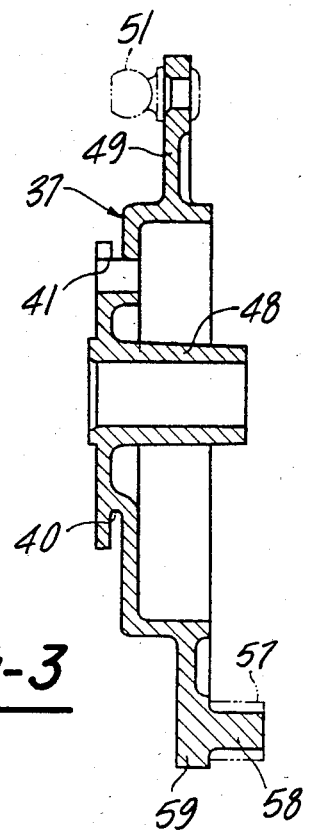
FIG. 3 is a cross-sectional view taken generally along the line 3—3 of FIG. 2.

The throttle and spark control mechanism is indicated generally by the reference numeral 36 and includes a throttle control lever, indicated generally by the reference numeral 37 that is mounted on the side of the engine 12 for rotation by means of a pivot bolt 38. The throttle control lever 37, as seen best in FIGS. 2 and 3, includes a drum shape portion 40 having a pair of notched recesses 39 and 41 to which respective ends of control cables 42 and 43 are affixed by ferrules 44 and 45. The cables 42 and 43 are contained within respective protective sheaths 46 which sheaths are affixed to a bracket 47 that is mounted on the side of the engine 12 in proximity to the pivot bolt 38. Tensioning of the cables 42 or 43 will effect rotation of the lever 37 in the clockwise or counterclockwise directions, respectively.

The drum 40 surrounds a hub portion 48 that is provided to affird the pivotal support on the pivot bolt 38. A first arm 49 extends radially outwardly and has a ball connector 51 that affords a pivotal connection to one end of a throttle control link 52. The opposite end of the throttle control link 52 is pivotally connected to the throttle control cam 22 so as to effect pivotal movement of it and control movement of the throttle valves 17 as the throttle control lever 37 is rotated.

Figure 4:
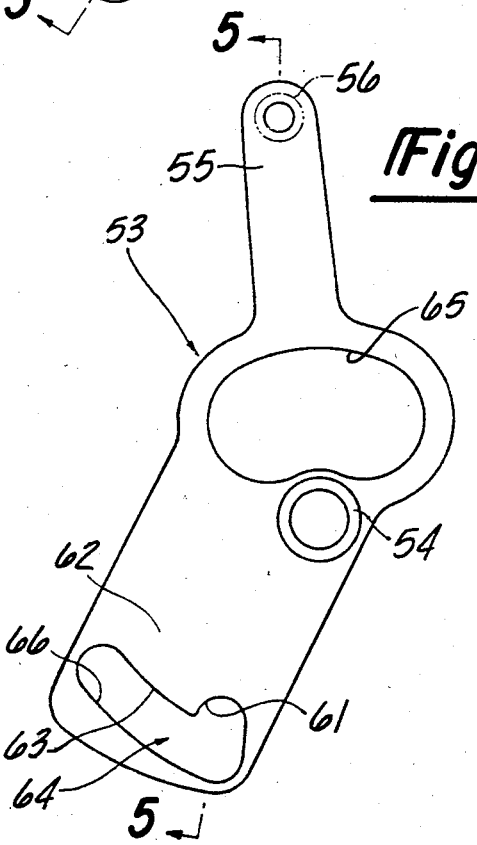
FIG. 4 is an enlarged side elevational view of the spark control lever.
Figure 5:
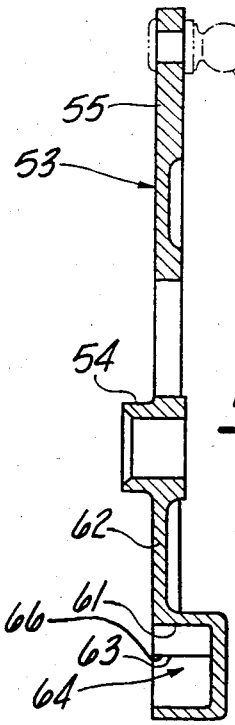
FIG. 5 is a cross-sectional view taken along the line 5—5 of FIG. 4.

The spark advance control base 34 is rotated under the control of a spark control lever, indicated generally by the reference numeral 53 and shown in most detail in FIGS. 4 and 5. Unlike the prior art constructions, the spark control lever 53 is rotated on the engine 12 about an axis that is not coincident with the axis of the throttle control lever 37. Rather, the spark control lever 53 is formed with a a journaled boss 54 that receives a pivot pin 55 (FIG. 1) so as to pivotally support the spark control lever 53 on the engine for rotation about an axis that is parallel to but offset from the axis of rotation of the throttle control lever 37.

The spark control lever 53 has an arm portion 55 that carries a ball member 56 of a ball and joint connection which is connected to one end of a spark control link 57. The opposite end of the spark control link 57 is pivotally connected by means of a similar ball and socket connection to the spark control base 34 so that rotation of the throttle control lever 53 will rotate the spark control base 34.

As may be seen from the schematic view of FIG. 6, the spark control lever 53 rotates about an axis $O^2$ which is offset from the axis of rotation $O_1$ of the throttle control lever 37, as has been previously noted. The transmission of rotary movement from the throttle control lever 37 to the spark control lever 53 is provided by means of a roller 57 that is supported on a projecting pin 58 formed by an arm 59 of the throttle control lever 37. The roller 57 is received in an actuating cam groove 61 formed in an arm 62 of the spark control lever 53. The actuating cam 61 merges into a dwell cam 63 with the cams 61 and 63 forming a generally L shaped cam surface 64.

The timing of the respective openings of the throttle valve 17 and rotation of the spark control base 34 may be best understood by reference to diagrammatic FIG. 6. The solid line views show the levers as they appear when the engine is positioned with the throttle valves 17 in an idle position and the spark advance of the base 34 set at its minimum. As the cable 34 is tensioned, the throttle control lever 37 will rotate in a clockwise direction as viewed in FIGS. 1 and 6. The engagement of the roller follower 57 with the advancing cam 61 will effect rotation of the spark control lever 53 about its pivot axis $O_2$ at an accelerated rate.

In the illustrated embodiment, the relationship is such that for a given degree of rotation of the throttle lever 37, the spark control lever 53 rotates through a substantially greater angle. This relative rotation continues until the throttle control lever 37 has rotated to its position indicated by the angle $\theta_1$, which correponds to the point at which maximum desired spark advance has been reached. At this time, the roller follower 57 will move out of the accelerating cam groove 61 and into the dwell cam groove. At this time, the spark advance lever 53 will have been rotated to an angle $\theta_2$, which, in the illustrated embodiment, is twice the angle $\theta_1$.

Thus, it should be readily apparent that a substantially greater angular movement of the spark control base 34 is provided with this mechanism without necessitating elongation of the spark control lever. This permits a compact assembly and, furthermore, affords good control of the spark advance. It should be noted that the spark advance lever 54 is provided with an elongated arcuate shape central opening 65 so as to clear the hub 48 of the throttle control lever 37 during this degree of rotation.

The cam groove 64 and particularly the dwell or lost motion section 63 has a surface 66 that is adapted to engage the roller 57 so as to prevent any return or reverse movement of the spark advance lever 53 until the throttle lever 37 moves sufficiently so as to permit the roller 57 to reengage the accelerating cam groove 61. Continued closing of the throttle valve 17 will then result in reverse movement and retarding of the spark.

Alternatively to using the locking cam surface 66 to hold the spark advance in its maximum advance positon, it would be possible to enlarge this slot and merely use a biasing spring to hold the spark advance lever 53 in its fully advanced spark condition until the throttle lever 37 is moved to the point at which spark retardation is demanded.

In the embodiment of the invention thus far illustrated and described, the spark advance lever was rotated relative to the throttle control lever at a predetermined speed ratio until the throttle control lever reached a predetermined angular throttle setting. Thereafter, the spark advance was held constant. It is possible, however, with a mechanism of this type to provide other timing relationships between movements of the spark control lever and throttle control lever. The way that this can be done may be understood by reference to FIG. 7 and the diagrammatic view of FIG. 8.

In FIG. 7, a spark control lever, which has the same general construction of the embodiment of FIGS. 1 through 6, is identified generally by the reference numeral 81 and is supported for rotation on the side of the associated engine about an axis $O_1$. In a similar manner, a spark control lever 82 is mounted adjacent to the throttle control lever 81 and is rotatable about an axis $O_2$ that is offset from the axis $O_1$. The throttle control lever 81 and spark control lever 82 may be connected to the appropriate throttle and spark controls through a linkage system of the type shown in the embodiment of FIGS. 1 and 6.

The throttle control lever 81 carries a roller follower 83 at one of its ends. The roller follower 83 rotates through an arc described by the radius $R_O$ from the center $O_1$. As in the previous embodiment, the roller follower 83 is engaged with a cam groove, indicated generally by the reference numeral 84 and which is formed in the spark control lever 82. The cam groove 84 consists of an accelerating portion 85 which is generally linear and aligned with a line passing through the axis $O_2$. The accelerating cam groove 85 merges into a further cam groove 86 which, in the illustrated embodiment, has a radius $R_1$ about a center line which is not necessarily coincident with the centerline $O_2$. Hence, as the throttle lever 81 rotates through the angle $\theta_1$, the spark advance lever 82 will rotate through an advanced angle $\theta_2$ which the roller 83 traverses the accelerating slot 85. FIG. 8 shows the diagrammatic effect of this operation where the curve A indicates that the spark advance, shown on the ordinate increases at a progressive rate but linearly relative to the opening of the throttle lever 81 as shown on the abscissa. The peak point indicates when the roller 83 leaves the grooves 85 and moves into the cam groove 86. At this time, the spark will be retarded as shown along with remaining portion of the curve A due to the reverse nature and the change in radii which will effect rotation of the spark control lever 82 in a counterclockwise direction.

Alternatively to causing retardation of the spark, the groove 85 may terminate in a groove 89 that has a radius $R_2$ and which is disposed about a different center so that the spark advance will be advanced rapidly up until the roller 83 leaves the grove 85 and enters the groove 89. The spark may then continue to be advanced but at a substantially reduced rate as shown by the curve B in FIG. 7. Of course, it should be readily apparent from this description that the actual relationship of movement between the throttle control lever 81 and the spark control lever 82 may be appropriately changed and it can result in a curve as shown in the curve C wherein the spark advances to a certain point, is then held constant for a period of rotation and subsequently reduced. This can be accomplished by incorporating a dwell curve into the cam opening 81.

It should be readily apparent from the foregoing description that an extremely compact and yet highly effective arrangement has been disclosed for controlling the movement of a throttle lever and spark advance lever and wherein the throttle lever may be moved through a greater range of angles for a given range of movement of the throttle member than with prior art constructions. The construction also permits the tailoring of the spark advance curve to the throttle position curve depending on engine requirements. Although the arrangement has been shown where the cam is carried by the throttle lever and the follower groove is formed on the spark control lever, it should be obvious that the relationship between these components could be reversed. Various other changes and modifications may be made, without departing from the spirit and scope of the invention, as defined by the appended claims.

I claim:

1. In a throttle and spark advance control system for an internal combustion engine having a spark advance mechanism and a throttle valve comprising an operator controlled element, a throttle control lever supported for pivotal movement about an axis and directly connected to said operator controlled element for rotation under operator control, means for positively connecting said throttle control lever to said throttle valve for positioning said throttle valve in response to movement of said throttle control lever, a spark advance control lever supported for pivotal movement about an axis, motion transmitting means for operatively connecting said spark advance control lever to said throttle control lever for pivotal movement of said spark advance control lever about its axis in response to pivotal movement of said throttle control lever about its axis and said spark control lever to said spark advance mechanism for controlling the position of said spark advance mechanism in response to the position of said throttle control lever, the improvement comprising said motion transmitting means effecting pivotal movement of said spark control lever at a different angular velocity than that of said throttle control lever during at least a range of angular movement of said throttle control lever, said control levers being supported for pivotal movement with their axes being juxtaposed to but offset from each other, said levers being in superimposed relationship with one of said control levers lying over the other of the control levers said motion transmitting means for operatively connecting the control levers comprising a slot formed in one of said control levers and follower means received in said slot for controlling the relative movement therebetween.

2. In a throttle and spark advance control system as set forth in claim 1 wherein the means for effecting pivotal movement of the spark advance control lever is further operative to effect pivotal movement of the spark advance control lever at a different angular velocity than the first mentioned angular velocity during another range of movement of the throttle valve control lever.

3. In a throttle and spark advance control system as set forth in claim 2 wherein the different angular velocity of the spark control lever comprises a dwell period when the spark control lever is not moved during rotation of the throttle control lever.

4. In a throttle and spark advance control system as set forth in claim 2 wherein the different angular velocity effects movement of the spark control lever at a slower rate relative to the first mentioned angular velocity during the throttle control lever movement.

* * * * *